US010451383B1

(12) United States Patent
Stephenson et al.

(10) Patent No.: US 10,451,383 B1
(45) Date of Patent: Oct. 22, 2019

(54) ALIGNMENT AID FOR A FIREARM

(71) Applicants: Allen Stephenson, Greenville, SC (US); Jake Edison, Greenville, SC (US); Jason Smith, Greenville, SC (US)

(72) Inventors: Allen Stephenson, Greenville, SC (US); Jake Edison, Greenville, SC (US); Jason Smith, Greenville, SC (US)

(73) Assignee: Wahrheit, LLC, Greenville, SC (US)

( * ) Notice: Subject to any disclaimer, the term of this patent is extended or adjusted under 35 U.S.C. 154(b) by 0 days.

(21) Appl. No.: 16/040,175

(22) Filed: Jul. 19, 2018

(51) Int. Cl.
*F41G 1/32* (2006.01)

(52) U.S. Cl.
CPC ..... *F41G 1/32* (2013.01)

(58) Field of Classification Search
CPC ... F41G 1/32; F41G 1/345; F41G 1/06; F41G 1/02
USPC ..... 42/132, 131, 144, 145
See application file for complete search history.

(56) References Cited

U.S. PATENT DOCUMENTS 5,836,100 A * 11/1998 Stover ..... F41G 1/345 42/132
5,926,963 A 7/1999 Knight
7,562,486 B2 7/2009 LoRocco
7,627,976 B1 * 12/2009 Olson ..... F41G 1/345 42/132
8,189,967 B1 * 5/2012 Olson ..... F41G 1/35 385/12
8,656,631 B2 * 2/2014 Koesler ..... F41G 1/027 42/132
8,677,674 B2 * 3/2014 Glimpse ..... F41G 1/02 42/132
8,813,413 B2 * 8/2014 Howe ..... F41G 1/08 42/132
9,335,118 B1 5/2016 Jackson
9,587,910 B1 * 3/2017 Jackson ..... F41G 1/345
9,638,492 B2 5/2017 Jones
9,909,838 B1 3/2018 Jackson
2006/0123687 A1 * 6/2006 Howe ..... F41G 1/345 42/145
2011/0314721 A1 * 12/2011 Lamb ..... F41G 1/10 42/145
2014/0109460 A1 * 4/2014 Howe ..... F41G 1/08 42/132
2014/0259855 A1 * 9/2014 Abo ..... F41G 1/345 42/132

(Continued)

OTHER PUBLICATIONS

Fiber Optic Sights: Which Color? (Internet article dated Jul. 2, 2017) https://www.thetruthaboutguns.com/2017/07/sam-hoober/fiber-optic-sights-which-color/ (Year: 2017).*

*Primary Examiner* — Reginald S Tillman, Jr.
(74) *Attorney, Agent, or Firm* — Steve LeBlanc, LLC

(57) ABSTRACT

An alignment aid for a firearm includes a first sight having a base portion and a shroud portion. A fiber optic rod has a proximal end, a distal end, and an upper surface that extends between the proximal and distal ends. The fiber optic rod is disposed between the shroud portion and the base portion of the first sight. The shroud portion of the first sight surrounds the upper surface of the fiber optic rod from the proximal end to the distal end of the fiber optic rod and includes a plurality of apertures through the shroud portion of the first sight between the proximal and distal ends of the fiber optic rod.

15 Claims, 7 Drawing Sheets

(56) References Cited

U.S. PATENT DOCUMENTS

2017/0016697 A1* 1/2017 Jones ..... F41G 1/345
2017/0219313 A1* 8/2017 Howe ..... F41G 1/01

* cited by examiner

ALIGNMENT AID FOR A FIREARM

FIELD OF THE INVENTION

The present disclosure generally involves an alignment aid for a firearm. In particular embodiments, the alignment aid may include one or more fiber optic sights.

BACKGROUND OF THE INVENTION

Many firearms include an alignment aid that assists a user to quickly and accurately aim the firearm. For example, handguns, shotguns, and rifles may include traditional "iron" sights that allow the user to aim the firearm at a target by visually lining up front and/or rear sights along the user's line of sight to the target. For many firearms, the sights are made from the same material and in the same color as the rest of the firearm. As a result, traditional sights may be difficult to quickly recognize and align, particularly in low light environments.

Fiber optic rods have been incorporated into firearm sights to enhance the visibility of the sights. Fiber optic rods are typically made from extruded plastic or glass that results in a flexible, semi-transparent fiber. Light entering the fiber refracts inside the fiber along the length of the fiber, making the fiber optic rods readily visible, even in low light environments. To further enhance visibility, florescent dyes may be added during manufacture to provide additional optical contrast between the fiber optic rod and adjacent materials.

A fiber optic sight typically includes a fiber optic rod incorporated into a traditional firearm sight. The firearm sight attaches to opposite ends of the fiber optic rod to hold the fiber optic rod in place, and the majority of the fiber optic rod remains uncovered by the sight. In this manner, the majority of the fiber optic rod is exposed to ambient light to enhance the optical contrast between the fiber optic rod and the associated sight. Although effective at creating the desired optical contrast, the exposed fiber optic rod is also more susceptible to inadvertent contact that results in increased wear and possibly damage to the fiber optic rod. As a result, the need exists for an improved alignment aid that can incorporate a fiber optic rod into a sight to provide the desired optical contrast while also protecting the fiber optic rod from inadvertent contact and damage.

BRIEF DESCRIPTION OF THE INVENTION

Aspects and advantages of this disclosure are set forth below in the following description, or may be obvious from the description, or may be learned through practice of the invention.

One embodiment of the present invention is an alignment aid for a firearm. The alignment aid includes a first sight having a base portion and a shroud portion. A fiber optic rod has a proximal end, a distal end, and an upper surface that extends between the proximal and distal ends. The fiber optic rod is disposed between the shroud portion and the base portion of the first sight. The shroud portion of the first sight surrounds the upper surface of the fiber optic rod from the proximal end to the distal end of the fiber optic rod and includes a plurality of apertures through the shroud portion of the first sight between the proximal and distal ends of the fiber optic rod.

Another embodiment of the present invention is an alignment aid for a firearm that includes a sight having a base portion and a left shroud portion laterally separated from a right shroud portion. A left fiber optic rod has a proximal end, a distal end, and an upper surface that extends between the proximal and distal ends. The left fiber optic rod is disposed between the left shroud portion and the base portion of the sight. A right fiber optic rod has a proximal end, a distal end, and an upper surface that extends between the proximal and distal ends. The right fiber optic rod is disposed between the right shroud portion and the base portion of the sight. The left shroud portion of the sight surrounds the upper surface of the left fiber optic rod from the proximal end to the distal end of the left fiber optic rod. The right shroud portion of the sight surrounds the upper surface of the right fiber optic rod from the proximal end to the distal end of the right fiber optic rod. A plurality of apertures extend through the left and right shroud portions of the sight between the proximal and distal ends of the left and right fiber optic rods.

Embodiments of the present invention also include an alignment aid for a firearm that includes a first sight and a second sight, wherein each sight comprises a base portion and a shroud portion. A first fiber optic rod includes a proximal end, a distal end, and an upper surface that extends between the proximal and distal ends, and the first fiber optic rod is disposed between the shroud portion and the base portion of the first sight. A second fiber optic rod includes a proximal end, a distal end, and an upper surface that extends between the proximal and distal ends, and the second fiber optic rod is disposed between the shroud portion and the base portion of the second sight. The shroud portion of the first sight surrounds the upper surface of the first fiber optic rod from the proximal end to the distal end of the first fiber optic rod. The shroud portion of the second sight surrounds the upper surface of the second fiber optic rod from the proximal end to the distal end of the second fiber optic rod. A plurality of apertures extend through the shroud portions of the first and second sights between the proximal and distal ends of the first and second fiber optic rods.

Those of ordinary skill in the art will better appreciate the features and aspects of such embodiments, and others, upon review of the specification.

BRIEF DESCRIPTION OF THE DRAWINGS

A full and enabling disclosure of the present invention, including the best mode thereof to one skilled in the art, is set forth more particularly in the remainder of the specification, including reference to the accompanying figures, in which.

DETAILED DESCRIPTION OF THE INVENTION

Figure 1:
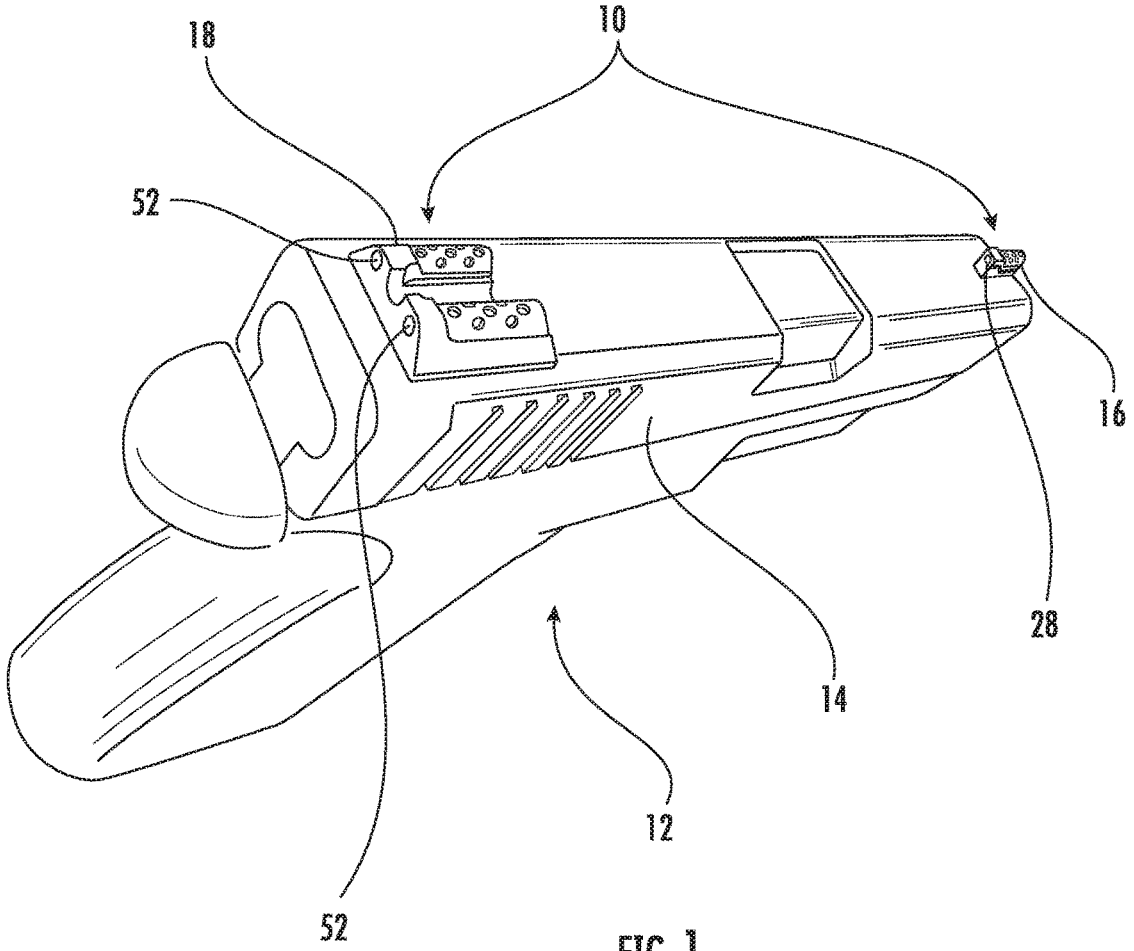
FIG. 1 is a rear perspective view of an alignment aid incorporated into a firearm according to one embodiment of the present invention.

Reference will now be made in detail to example embodiments of the present disclosure, one or more examples of which are illustrated in the accompanying drawings. The detailed description uses numerical and letter designations to refer to features in the drawings. Like or similar designations in the drawings and description have been used to refer to like or similar parts of example embodiments of the present disclosure. Each example is provided by way of explanation of the present disclosure, not limitation of the present disclosure. In fact, it will be apparent to those skilled in the art that modifications and variations can be made in the present invention without departing from the scope or spirit thereof. For instance, features illustrated or described as part of one embodiment may be used on another embodiment to yield a still further embodiment. Thus, it is intended that the present invention covers such modifications and variations as come within the scope of the appended claims and their equivalents.

Embodiments of the present invention provide one or more fiber optic sights separately, or incorporated into a firearm, to assist a user to more accurately and/or more quickly aim the firearm. As used herein, references to a firearm in the preamble and body of the claims is for contextual purposes only and is not intended to be a limitation of any claim. As used herein, the terms "first," "second," and "third" may be used interchangeably to distinguish one component from another and are not intended to signify location or importance of the individual components. As used herein, the term "axial" refers to a direction along a length of an object; the term "radial" refers to a direction extending away from the center of an object or normal to the "axial" direction, and the term "circumferential" refers to a direction extending around the circumference or perimeter of an object.

FIG. 1 provides a rear perspective view of an alignment aid 10 incorporated into a firearm 12 according to one embodiment of the present invention. As is known in the art, the firearm 12 generally includes a barrel that terminates at a muzzle. A projectile travels through the barrel and out of the muzzle along a longitudinal axis coincident with an aim point of the firearm. For the particular firearm 12 shown in FIG. 1, a slide 14 surrounds and encloses the barrel to provide a suitable platform for the alignment aid 10, as well as other functional capability for the firearm 12 not relevant to the present invention. One of ordinary skill in the art will readily appreciate that for other firearm designs, such as a revolver, rifle, or shotgun, the alignment aid 10 may attach directly to the barrel or other suitable structure, and the present invention is not limited to any particular location of the alignment aid 10 unless specifically recited in the claims.

As shown in FIG. 1, the alignment aid 10 may include a front sight 16 and/or a rear sight 18 that may be temporarily or permanently attached to the firearm 12. Alternately, the front and rear sights 16, 18 may be integrally incorporated into the manufacture of the firearm 12 itself, such as through molding, forging, casting, etching, or other suitable manufacturing techniques. For illustrative purposes, embodiments of the present invention will be described in the context of a hand gun 12. However, the present invention is not limited to any particular firearm 12 unless recited in the claims, and embodiments of the present invention may be suitably adapted for use with a rifle, shotgun, or virtually any other firearm that would benefit from faster, easier, and/or more accurate alignment with a desired target.

Figure 2:
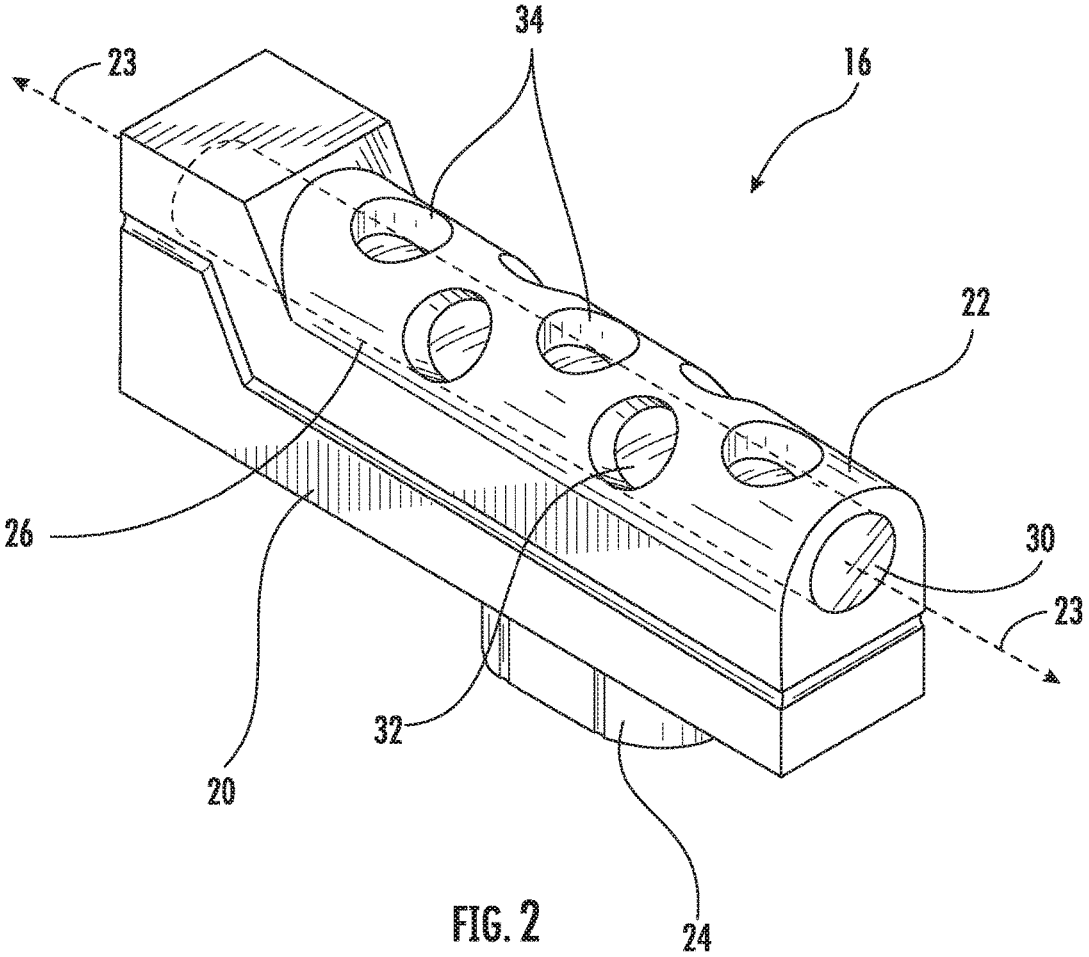
FIG. 2 is a front perspective view of the front fiber optic sight shown in FIG. 1.
Figure 3:
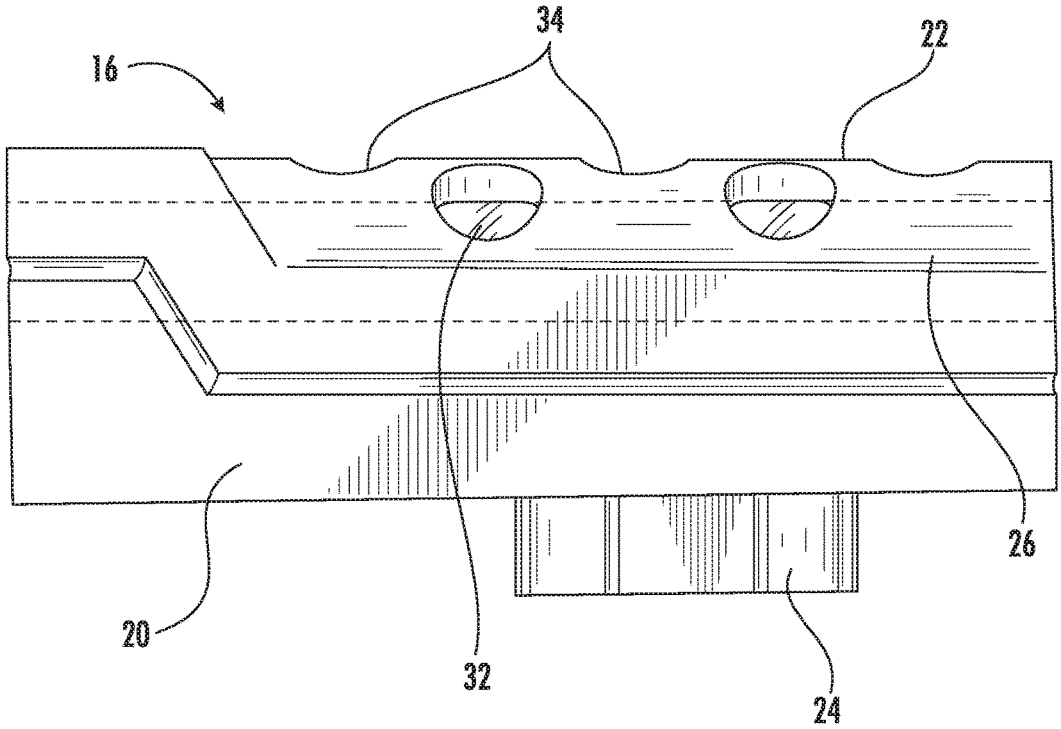
FIG. 3 is a side plan view of the front fiber optic sight shown in FIG. 1.
Figure 4:
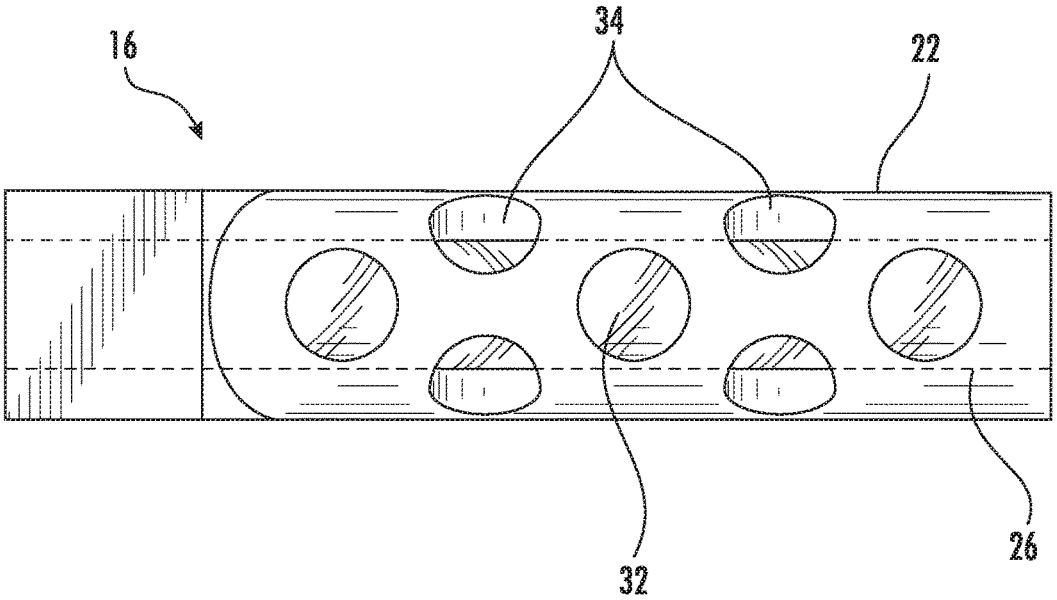
FIG. 4 is a top plan view of the front fiber optic sight shown in FIG. 1.

FIGS. 2-4 provide front perspective, side plan, and top plan views, respectively, of the front sight 16 shown in FIG. 1. The particular size and shape of the front sight 16 may vary according to the particular firearm 12 and intended application. In the embodiment shown in FIGS. 2-4, the front sight 16 includes a base portion 20 and a shroud portion 22. As shown in FIG. 2, a longitudinal bore 23 extends through the shroud portion 22 of the front sight 16. A projection 24 may extend from the base portion 20 of the front sight 16 and be configured to connect to the firearm 12. For example, as shown in FIGS. 2 and 3, the projection 24 may be configured to press fit into the slide 14 of the firearm 12 to fixedly hold the front sight 16 in place, as shown in FIG. 1.

The front sight 16 further includes a fiber optic rod 26 (shown in phantom in FIGS. 2-4) located between the base portion 20 and the shroud portion 22. The fiber optic rod 26 optically contrasts with at least a portion of the front sight 16 to enhance visibility of the fiber optic rod 26. For example, the base portion 20 and shroud portion 22 of the front sight 16 may be painted or colored black, and the fiber optic rod 26 may have an orange, red, yellow, or any other color that optically contrasts with black to provide a readily visible contrast between the fiber optic rod 26 and the rest of the front sight 16. The fiber optic rod 26 generally includes a proximal end 28, a distal end 30, and an upper surface 32 that extends between the proximal and distal ends 28, 30. As shown in FIGS. 1-4, the shroud portion 22 of the front sight 16 surrounds the upper surface 32 of the fiber optic rod 26 from the proximal end 28 to the distal end 30.

A plurality of apertures 34 through the shroud portion 22 of the front sight 16 between the proximal and distal ends 28, 30 of the fiber optic rod 26 allow ambient light to reach and illuminate the fiber optic rod 26. In particular embodiments, the plurality of apertures 34 through the shroud portion 22 of the front sight 16 may be separated axially and radially along the upper surface 32 of the fiber optic rod 26 to further enhance light absorption by and visibility of the fiber optic rod 26. In this manner, the shroud portion 22 of the front sight 16 permits sufficient ambient light to reach the fiber optic rod 26 while also shielding and protecting the fiber optic rod 26 from inadvertent contact and damage.

Figure 5:
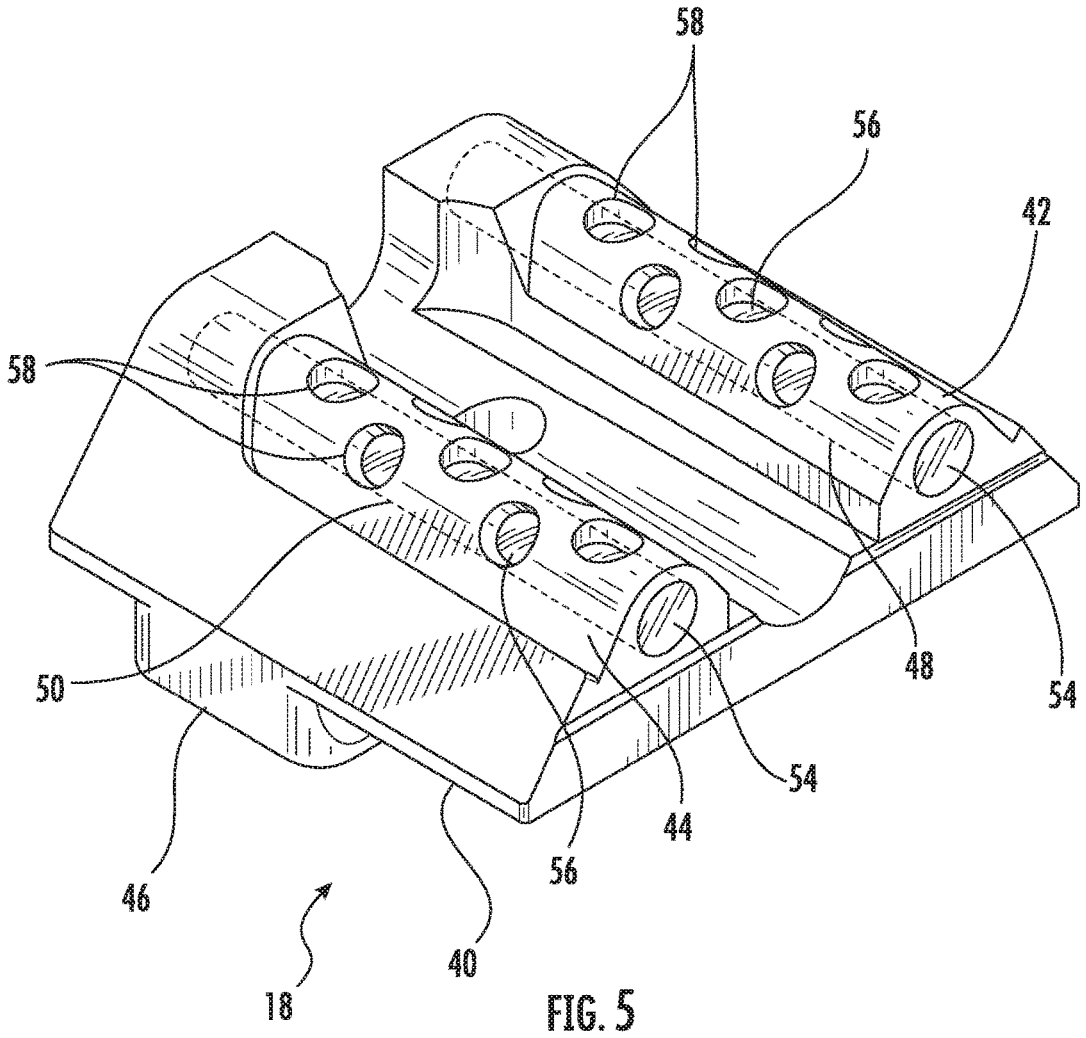
FIG. 5 is a front perspective view of the rear fiber optic sight shown in FIG. 1.
Figure 6:
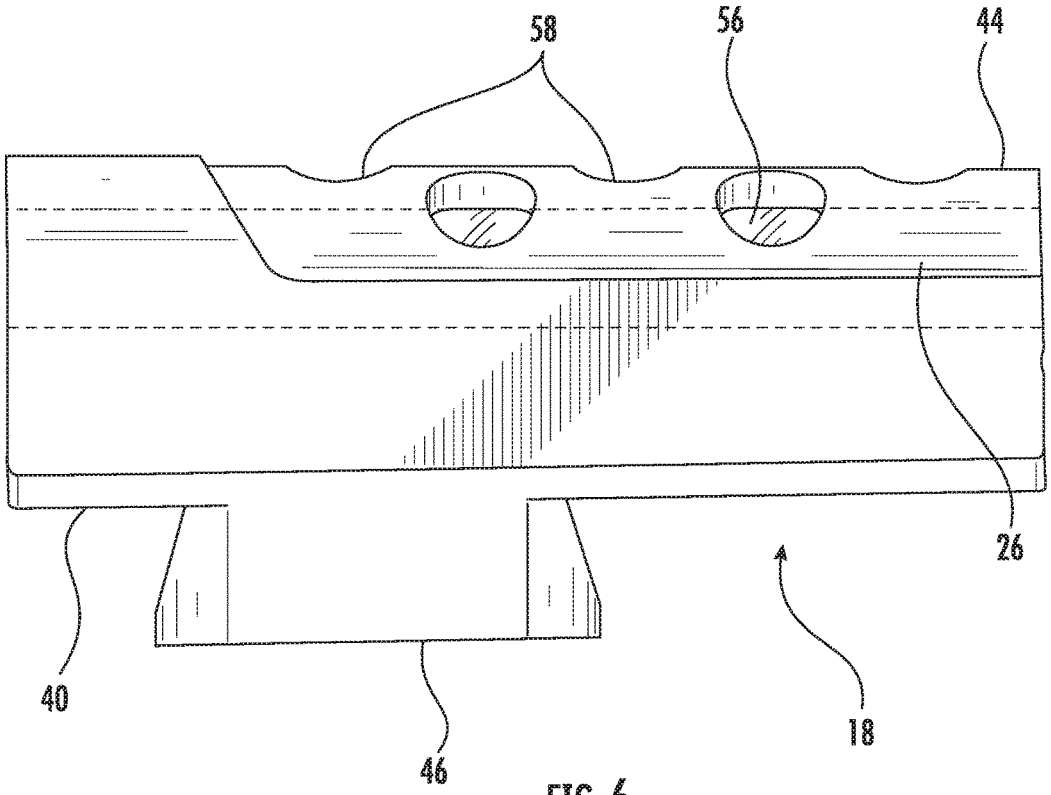
FIG. 6 is a side plan view of the rear fiber optic sight shown in FIG. 1.
Figure 7:
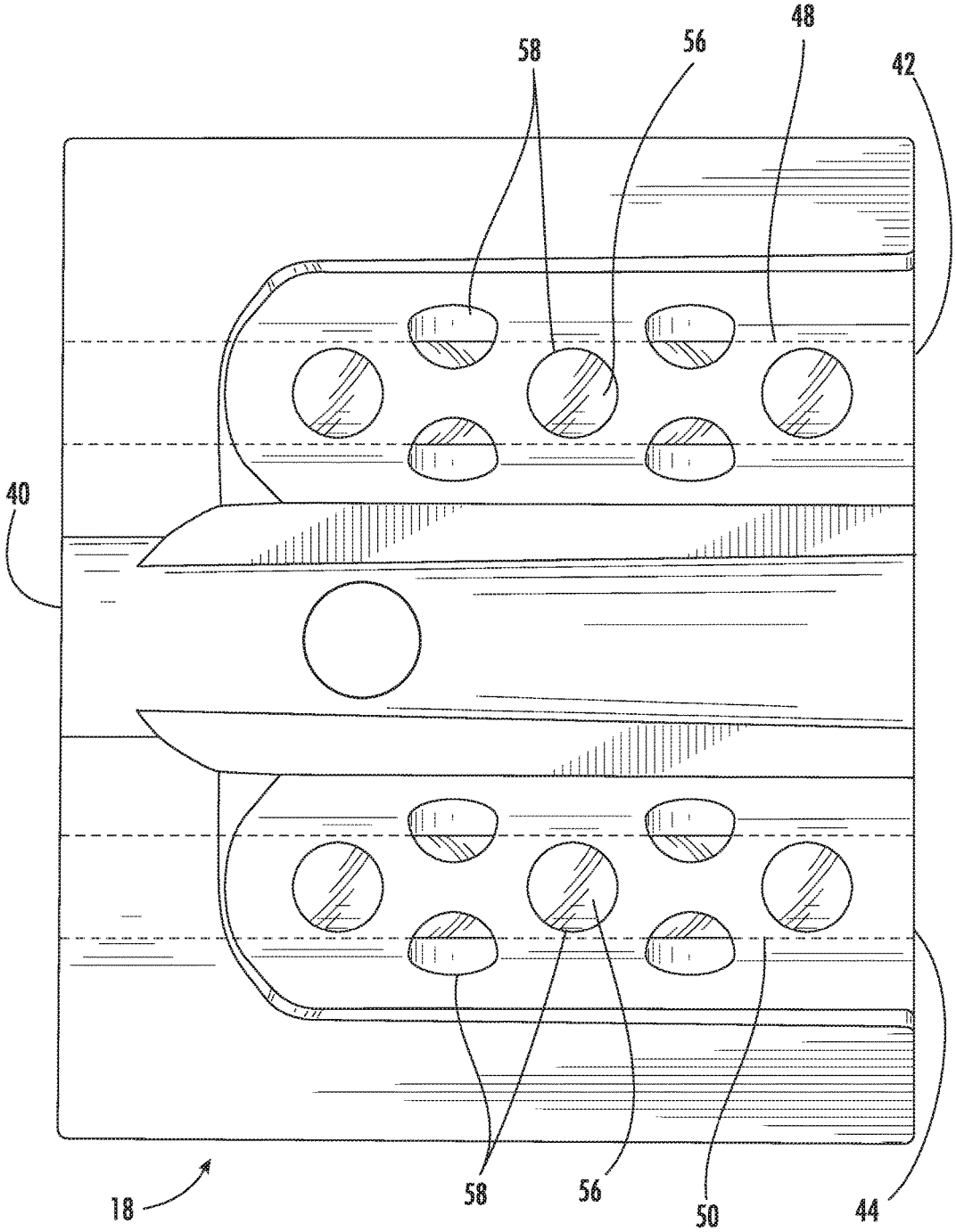
FIG. 7 is a top plan view of the rear fiber optic sight shown in FIG. 1.

FIGS. 5-7 provide front perspective, side plan, and top plan views, respectively, of the rear sight 18 shown in FIG. 1. The particular size and shape of the rear sight 18 may vary according to the particular firearm 12 and intended application. In the embodiment shown in FIGS. 5-7, the rear sight 18 includes a base portion 40 and a left shroud portion 42 laterally separated from a right shroud portion 44. As shown in FIG. 5, a longitudinal bore 43 extends through each of the left and right shroud portions 42, 44 of the rear sight 18. A projection 46 may extend from the base portion 40 of the rear sight 18 and be configured to connect to the firearm 12. For example, as shown in FIGS. 5 and 6, the projection 46 may be configured to press fit into the slide 14 of the firearm 12 to fixedly hold the rear sight 18 in place, as shown in FIG. 1.

The rear sight 18 further includes a left fiber optic rod 48 (shown in phantom in FIGS. 5-7) located between the base portion 40 and the left shroud portion 42 and a right fiber optic rod 50 (shown in phantom in FIGS. 5-7) located between the base portion 40 and the right shroud portion 44. The left and right fiber optic rods 48, 50 optically contrast with at least a portion of the rear sight 18 to enhance visibility of the fiber optic rods 48, 50, and in particular embodiments, the left and right fiber optic rods 48, 50 may optically contrast with the fiber optic rod 26 of the front sight 16 to allow faster alignment of the front and rear sights 16, 18. Each of the left and right fiber optic rods 48, 50 generally includes a proximal end 52, a distal end 54, and an upper surface 56 that extends between the proximal and distal ends 52, 54. As shown in FIGS. 1 and 5-7, the left shroud portion 42 of the rear sight 18 surrounds the upper surface 56 of the left fiber optic rod 48 from the proximal end 52 to the distal end 54, and the right shroud portion 44 of the rear sight 18 surrounds the upper surface 56 of the right fiber optic rod 50 from the proximal end 52 to the distal end 54.

A plurality of apertures 58 through the left and right shroud portions 42, 44 of the rear sight 18 between the proximal and distal ends 52, 54 of the left and right fiber optic rods 48, 50 allow ambient light to reach and illuminate the left and right fiber optic rods 48, 50. In particular embodiments, the plurality of apertures 58 through the left and right shroud portions 42, 44 of the rear sight 18 may be separated axially and radially along the upper surfaces 56 of the left and right fiber optic rods 48, 50 to further enhance light absorption by and visibility of the left and right fiber optic rods 48, 50. In this manner, the left and right shroud portions 42, 44 of the rear sight 18 permit sufficient ambient light to reach the left and right fiber optic rods 48, 50 while also shielding and protecting the left and right fiber optic rods 48, 50 from inadvertent contact and damage.

FIG. 1 shows the alignment aid 10 having the front sight 16, described and illustrated with respect to FIGS. 2-4, and the rear sight 18, described and illustrated with respect to FIGS. 5-7, temporarily or permanently attached to the firearm 12. As shown in FIG. 1, the shroud portion 22 of the front sight 16 protects the fiber optic rod 26 from inadvertent contact and damage, while the apertures 34 in the shroud portion 22 of the front sight 16 allow ambient light to reach and illuminate the fiber optic rod 26. Similarly, the left and right shroud portions 42, 44 of the rear sight 18 protect the left and right fiber optic rods 48, 50, respectively, from inadvertent contact and damage, while the apertures 58 in the left and right shroud portions 42, 44 of the rear sight 18 allow ambient light to reach and illuminate the left and right fiber optic rods 48, 50. As a result, the user can more accurately and/or more quickly align the proximal end 28 of the fiber optic rod 26 in the front sight 16 with the proximal ends 52 of the left and right fiber optic rods 48, 50 in the rear sight 18 to more accurately and/or more quickly aim the firearm 12.

This written description uses examples to disclose the invention, including the best mode, and also to enable any person skilled in the art to practice the invention, including making and using any devices or systems and performing any incorporated methods. The patentable scope of the invention is defined by the claims and may include other examples that occur to those skilled in the art. Such other examples are intended to be within the scope of the claims if they include structural elements that do not differ from the literal language of the claims, or if they include equivalent structural elements with insubstantial differences from the literal language of the claims.

What is claimed is:

1. An alignment aid for a firearm, the alignment aid comprising:

a first sight wherein said first sight comprises a base portion and a shroud portion;

a longitudinal bore that extends through said shroud portion of said first sight;

a fiber optic rod wherein said fiber optic rod comprises a proximal end, a distal end, and an upper surface that extends between said proximal and distal ends, and said fiber optic rod is disposed between said shroud portion and said base portion of said first sight;

wherein said shroud portion of said first sight surrounds said upper surface of said fiber optic rod from said proximal end to said distal end of said fiber optic rod;

a plurality of apertures through said shroud portion of said first sight between said proximal and distal ends of said fiber optic rod; and a second sight wherein said second sight comprises a base portion and a left shroud portion laterally separated from a right shroud portion;

a left fiber optic rod wherein said left fiber optic rod comprises a proximal end, a distal end, and an upper surface that extends between said proximal and distal ends, and said left fiber optic rod is disposed between said left shroud portion and said base portion of said second sight;

a right fiber optic rod wherein said right fiber optic rod comprises a proximal end, a distal end, and an upper surface that extends between said proximal and distal ends, and said right fiber optic rod is disposed between said right shroud portion and said base portion of said second sight;

wherein said left shroud portion of said second sight surrounds said upper surface of said left fiber optic rod from said proximal end to said distal end of said left fiber optic rod;

wherein said right shroud portion of said second sight surrounds said upper surface of said right fiber optic rod from said proximal end to said distal end of said right fiber optic rod; and a plurality of apertures through said left and right shroud portions of said second sight between said proximal and distal ends of said left and right fiber optic rods.

2. The alignment aid as in claim 1, further comprising a first projection extending from said base portion of said first sight and configured to connect to the firearm.

3. The alignment aid as in claim 1, wherein said fiber optic rod optically contrasts with at least a portion of said first sight.

4. The alignment aid as in claim 1, wherein said plurality of apertures through said shroud portion of said first sight are separated axially and radially along said upper surface of said fiber optic rod.

5. The alignment aid as in claim 1, further comprising a second projection extending from said base portion of said second sight and configured to connect to the firearm.

6. The alignment aid as in claim 1, wherein said left and right fiber optic rods optically contrast with at least a portion of said second sight.

7. The alignment aid as in claim 1, wherein said fiber optic rod optically contrasts with said left and right fiber optic rods.

8. The alignment aid as in claim 1, wherein said plurality of apertures through said left and right shroud portions of said second sight are separated axially and radially along said upper surfaces of said left and right fiber optic rods.

9. An alignment aid for a firearm, the alignment aid comprising: a sight wherein said sight comprises a base portion and a left shroud portion laterally separated from a right shroud portion; a longitudinal bore that extends through each of said left and right shroud portions of said sight; a left fiber optic rod wherein said left fiber optic rod comprises a proximal end, a distal end, and an upper surface that extends between said proximal and distal ends, and said left fiber optic rod is disposed between said left shroud portion and said base portion of said sight;

a right fiber optic rod wherein said right fiber optic rod comprises a proximal end, a distal end, and an upper surface that extends between said proximal and distal ends, and said right fiber optic rod is disposed between said right shroud portion and said base portion of said sight; wherein said left shroud portion of said sight surrounds said upper surface of said left fiber optic rod from said proximal end to said distal end of said left fiber optic rod;

wherein said right shroud portion of said sight surrounds said upper surface of said right fiber optic rod from said proximal end to said distal end of said right fiber optic rod; and a plurality of apertures through said left and right shroud portions of said sight between said proximal and distal ends of said left and right fiber optic rods, wherein said plurality of apertures through said left and right shroud portions of said sight are separated axially and radially along said upper surfaces of said left and right fiber optic rods.

10. The alignment aid as in claim 9, further comprising a projection extending from said base portion of said sight and configured to connect to the firearm.

11. The alignment aid as in claim 9, wherein said left and right fiber optic rods optically contrast with at least a portion of said sight.

12. An alignment aid for a firearm, the alignment aid comprising: a first sight and a second sight wherein each sight comprises a base portion and a shroud portion; a longitudinal bore that extends through said shroud portion of each of said first and second sights; a first fiber optic rod wherein said first fiber optic rod comprises a proximal end, a distal end, and an upper surface that extends between said proximal and distal ends, and said first fiber optic rod is disposed between said shroud portion and said base portion of said first sight; a second fiber optic rod wherein said second fiber optic rod comprises a proximal end, a distal end, and an upper surface that extends between said proximal and distal ends, and said second fiber optic rod is disposed between said shroud portion and said base portion of said second sight; wherein said shroud portion of said first sight surrounds said upper surface of said first fiber optic rod from said proximal end to said distal end of said first fiber optic rod; wherein said shroud portion of said second sight surrounds said upper surface of said second fiber optic rod from said proximal end to said distal end of said second fiber optic rod; and a plurality of apertures through said shroud portions of said first and second sights between said proximal and distal ends of said first and second fiber optic rods, wherein said plurality of apertures through said shroud portions of said first and second sights are separated axially and radially along said upper surfaces of said first and second fiber optic rods.

13. The alignment aid as in claim 12, further comprising a projection extending from said base portions of said first and second sights and configured to connect to the firearm.

14. The alignment aid as in claim 12, wherein said first and second fiber optic rods optically contrast with at least a portion of said first and second sights.

15. The alignment aid as in claim 12, wherein said first fiber optic rod optically contrasts with said second fiber optic rod.

* * * * *